US010260315B2

(12) United States Patent
Schultz et al.

(10) Patent No.: US 10,260,315 B2
(45) **Date of Patent: *Apr. 16, 2019**

(54) DOWNHOLE BYPASS TOOL

(71) Applicant: Thru Tubing Solutions, Inc., Oklahoma City, OK (US)

(72) Inventors: Roger Schultz, Newcastle, OK (US); Andy Ferguson, Moore, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/910,389

(22) Filed: Mar. 2, 2018

(65) Prior Publication Data

US 2018/0187516 A1 Jul. 5, 2018

Related U.S. Application Data

(63) Continuation of application No. 14/878,873, filed on Oct. 8, 2015, now Pat. No. 10,000,992, which is a (Continued)

(51) Int. Cl.
*E21B 34/12* (2006.01)
*E21B 21/10* (2006.01)
(Continued)

(52) U.S. Cl.
CPC ..... *E21B 34/12* (2013.01); *E21B 21/103* (2013.01); *E21B 28/00* (2013.01); *E21B 29/00* (2013.01); *E21B 31/005* (2013.01); *E21B 34/14* (2013.01); *E21B 43/114* (2013.01); *E21B 2034/007* (2013.01)

(58) Field of Classification Search
CPC .. E21B 2034/007; E21B 21/103; E21B 28/00; E21B 29/00; E21B 31/005; E21B 34/12; E21B 34/14; E21B 43/114
See application file for complete search history.

(56) References Cited

U.S. PATENT DOCUMENTS 4,058,163 A * 11/1977 Yandell ..... E21B 4/02 166/177.6
2005/0121233 A1 6/2005 Frith
(Continued)

FOREIGN PATENT DOCUMENTS

WO 2012018700 A2 2/2012

OTHER PUBLICATIONS

PCT/US2014/067466; International Search Report and Written Opinion; dated Mar. 20, 2015; 22 pages.

*Primary Examiner* — Caroline N Butcher
(74) *Attorney, Agent, or Firm* — Hall Estill Law Firm

(57) ABSTRACT

A downhole bypass tool that includes an inlet for receiving fluid into a housing of the bypass tool is described herein. The bypass tool also includes a flow directing apparatus disposed in the housing for directing fluid to flow into an operational flow path of a vibratory tool. The vibratory tool is at least partially disposed within the hosing of the bypass tool. The flow directing apparatus operates to selectively bypass the operational flow path of the vibratory tool such that the fluid bypasses the operational flow path of the vibratory tool and flows out of an outlet of the bypass tool.

7 Claims, 12 Drawing Sheets

Related U.S. Application Data continuation of application No. 14/553,719, filed on Nov. 25, 2014, now Pat. No. 9,181,767.

(60) Provisional application No. 61/909,191, filed on Nov. 26, 2013.

(51) Int. Cl.

| | |
|---|---|
| ***E21B 34/14*** | (2006.01) |
| ***E21B 43/114*** | (2006.01) |
| ***E21B 29/00*** | (2006.01) |
| ***E21B 28/00*** | (2006.01) |
| ***E21B 31/00*** | (2006.01) |
| *E21B 34/00* | (2006.01) |

(56) References Cited

U.S. PATENT DOCUMENTS

| | | | | |
|---|---|---|---|---|
| 2008/0135248 | A1 | 6/2008 | Talley et al. | |
| 2010/0031615 | A1* | 2/2010 | Ringenberger ..... | B01D 35/301 55/290 |
| 2010/0276204 | A1* | 11/2010 | Connell ..... | E21B 28/00 175/293 |
| 2012/0031615 | A1 | 2/2012 | Connell | |
| 2012/0118557 | A1 | 5/2012 | Ferguson et al. | |
| 2013/0213646 | A1 | 8/2013 | Angman et al. | |

* cited by examiner

DOWNHOLE BYPASS TOOL

CROSS-REFERENCE TO RELATED APPLICATIONS

The present application is a continuation application of U.S. Patent Application having U.S. Ser. No. 14/878,873, filed Oct. 8, 2015, which is a continuation application of U.S. Patent Application having U.S. Ser. No. 14/553,719, filed Nov. 25, 2014, which is a conversion of U.S. Provisional Application having U.S. Ser. No. 61/909,191, filed Nov. 26, 2013, which claims the benefit under 35 U.S.C. 119(e), the disclosure of which is hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present disclosure relates to a downhole tool that permits fluid to bypass a vibratory tool.

2. Description of the Related Art

Vibratory tools can be used in bottom hole assemblies (BHAs) along with other tools that can use abrasive fluids, such as an abrasive perforator. Flowing an abrasive fluid through a vibratory tool would, at the very least, significantly reduce the life of the vibratory tool. Additionally, pressure drop at a perforator can be reduced due to the pressure drop across a vibratory tool.

Accordingly, there is a need for a downhole tool that will permit the abrasive fluid to bypass the vibratory tool.

SUMMARY OF THE DISCLOSURE

The present disclosure is directed to a downhole bypass tool that includes an inlet for receiving fluid into a housing of the bypass tool. The bypass tool also includes a flow directing apparatus disposed in the housing for directing fluid to flow into an operational flow path of a vibratory tool. The vibratory tool is at least partially disposed within the hosing of the bypass tool. The flow directing apparatus operates selectively bypass the operational flow path of the vibratory tool such that the fluid bypasses the operational flow path of the vibratory tool and flows out of an outlet of the bypass tool.

The present disclosure is also directed toward of method of using the bypass tool. A bottom hole assembly (BHA) can be sent into a well, the BHA including a vibratory tool disposed above a perforator in the BHA. Fluid is pumped to an operational flow path of the vibratory tool to operate the vibratory tool. Abrasive fluid can be pumped through the operational flow path of the vibratory tool to the perforator to create perforations in the well.

DETAILED DESCRIPTION OF THE DISCLOSURE

Figure 1A:
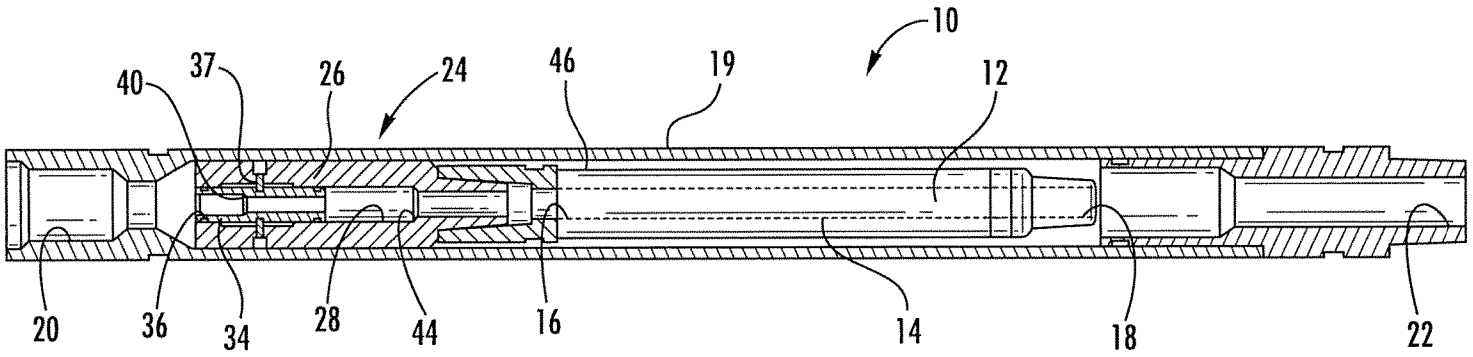
FIG. 1A is a cross-sectional view of a bypass tool constructed in accordance with the present disclosure.

The present disclosure relates to a bypass tool 10 run down into a well as part of a bottom hole assembly (BHA). The bypass tool 10 is used to divert the flow of fluid from a vibratory tool 12, which is selectively in fluid communication with the bypass tool 10. The vibratory tool 12 can be any tool known in the art for providing vibration and/or agitation to a BHA to advance the BHA in the well. The fluid can be diverted around or through a portion of the the vibratory tool 12. The vibratory tool 12 can be disposed within the bypass tool 10, partially within the bypass tool 10 or positioned adjacent to the bypass tool 10 on the downhole side of the bypass tool 10. Generally, the vibratory tool 12 can include an operational flow path 14 having an inlet 16 and an outlet 18. When fluid is permitted to flow into the operational flow path 14, the vibratory tool 12 operates as intended. It should be understood and appreciated that the vibratory tool 12 does not have to be a completely separate tool. For example, the bypass tool 10 may include components that cause the bypass tool 10 to vibrate.

Figure 1B:
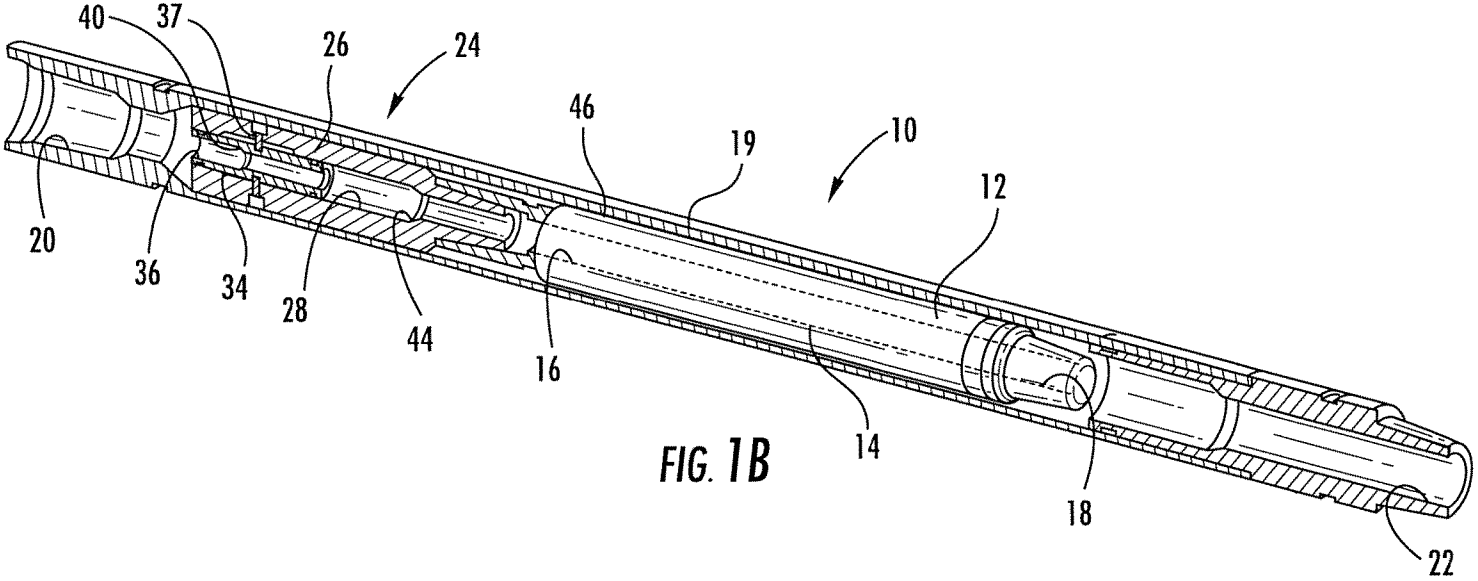
FIG. 1B is a perspective view of the bypass tool constructed in accordance with the present disclosure.
Figure 1C:
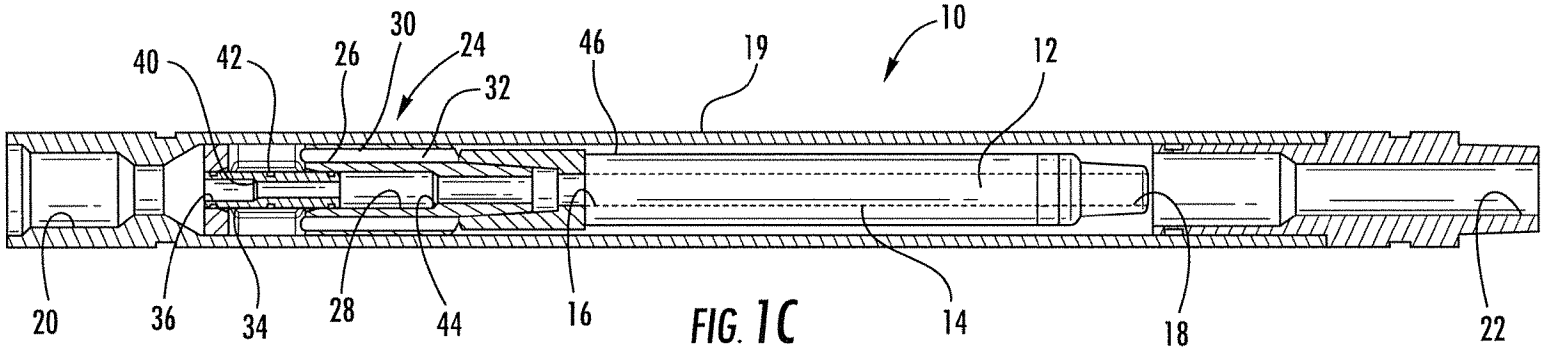
FIG. 1C is a cross-sectional view of the bypass tool shown in FIG. 1A rotated 90° constructed in accordance with the present disclosure.
Figure 1D:
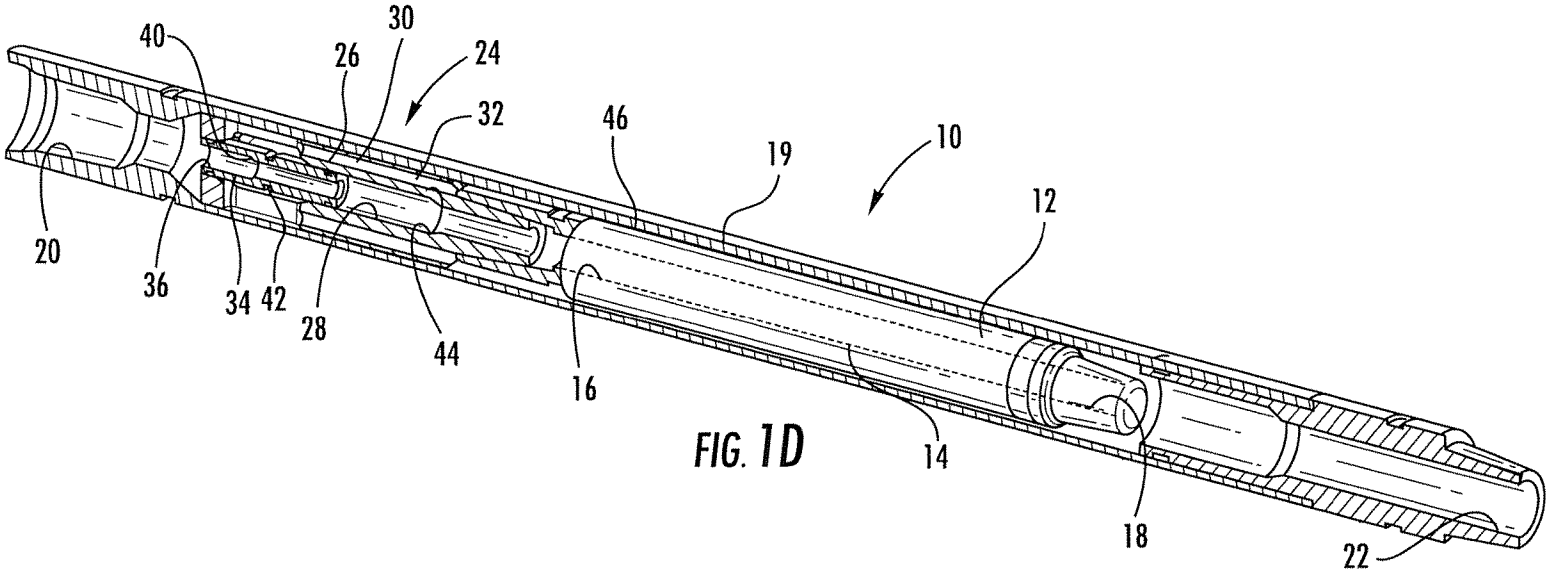
FIG. 1D is a perspective view of the the bypass tool shown in FIG. 1C rotated 90° constructed in accordance with the present disclosure.
Figure 2A:
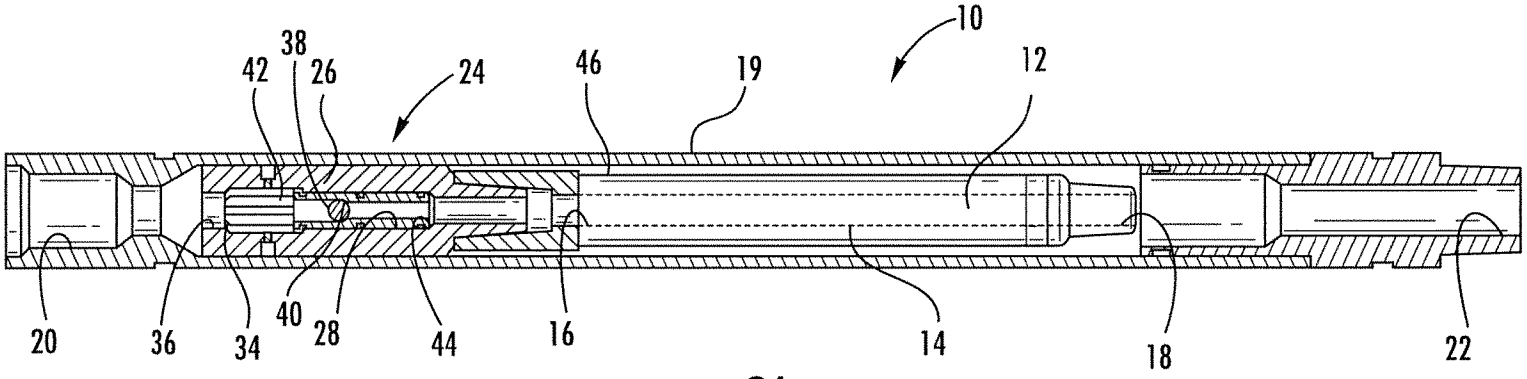
FIG. 2A is a cross-sectional view of another embodiment of the bypass tool constructed in accordance with the present disclosure.
Figure 2B:
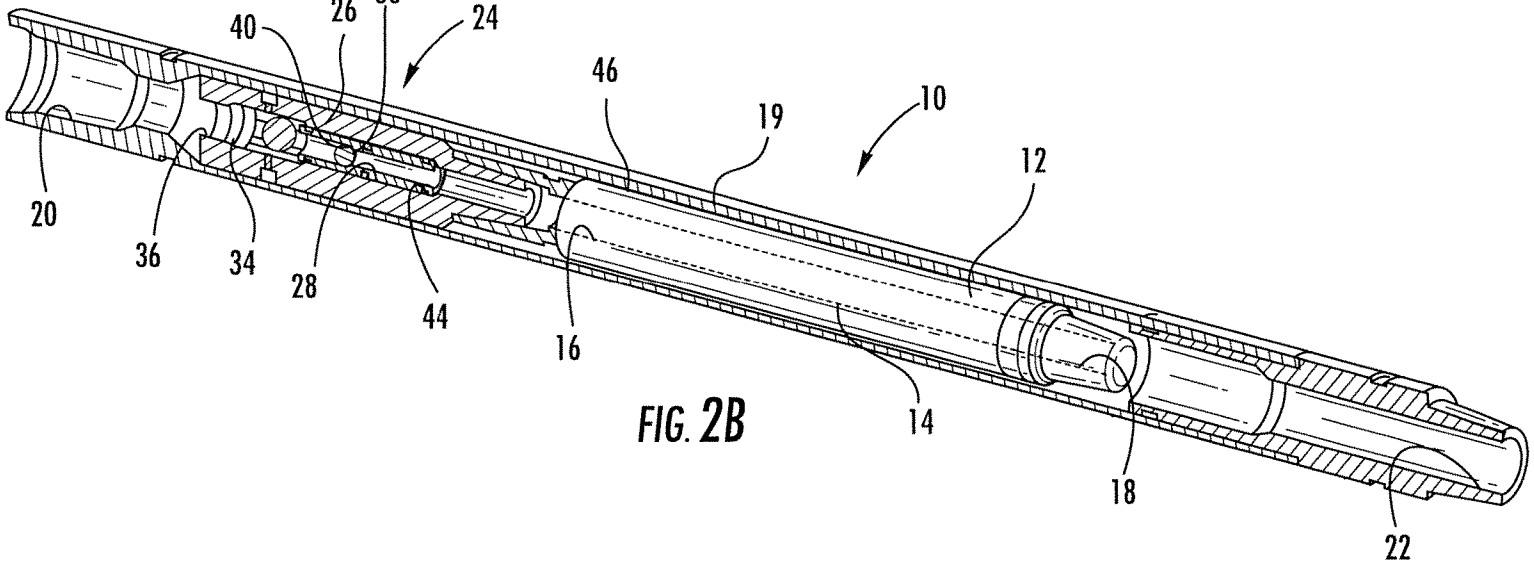
FIG. 2B is a perspective view of another embodiment of the bypass tool constructed in accordance with the present disclosure.
Figure 2C:
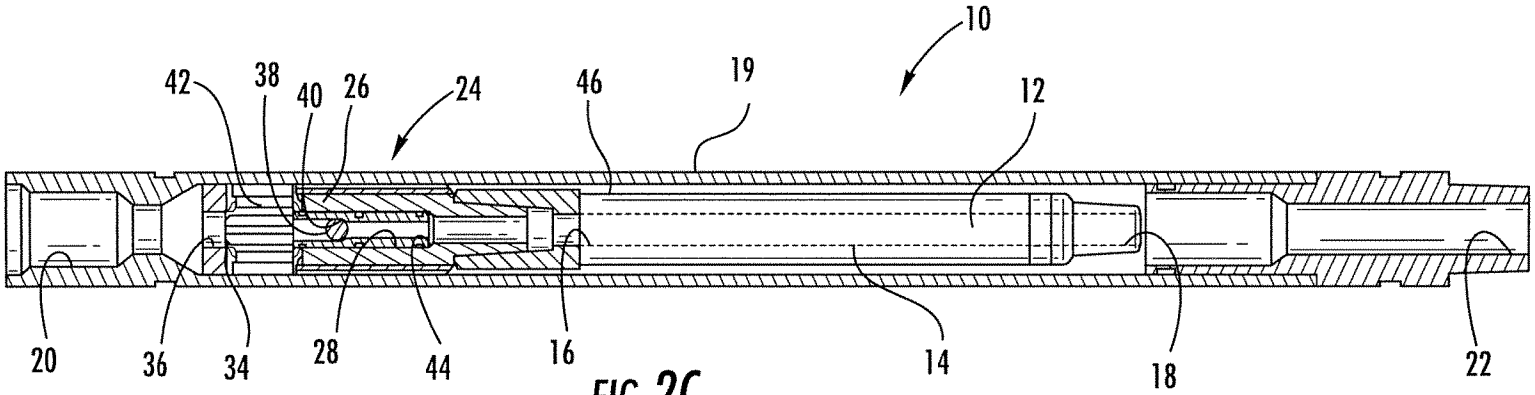
FIG. 2C is a cross-sectional view of the bypass tool shown in FIG. 2A rotated 90° constructed in accordance with the present disclosure.
Figure 2D:
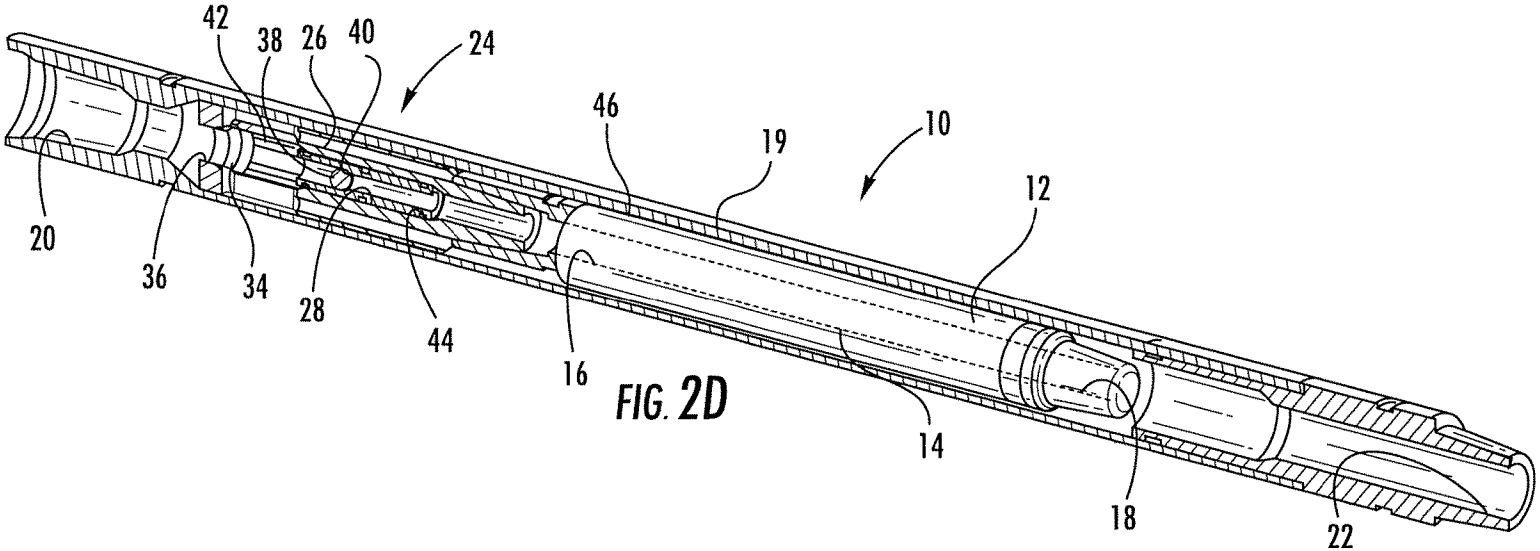
FIG. 2D is a perspective view of the the bypass tool shown in FIG. 2C rotated 90° constructed in accordance with the present disclosure.

Referring now to FIGS. 1A-2D, the bypass tool 10 includes an inlet 20 for allowing fluid to flow into the bypass tool 10, an outlet 22 for allowing fluid to flow out of the bypass tool 10, a flow directing apparatus 24 disposed between the inlet 20 and outlet 22 for selectively diverting the flow of fluid from the operational flow path 14 of the vibratory tool 12, and a housing 19.

In one embodiment, the flow directing apparatus 24 includes a body 26 in fluid communication with the inlet 20 of the bypass tool 10, a first passageway 28 disposed in the body 26 in fluid communication with the operational flow path 14 of the vibratory tool 12, a second passageway 30 disposed in an outer portion 32 of the body 26 or outside of the body 26 for diverting fluid away from the operational flow path 14 of the vibratory tool 12, and a sleeve 34 slidably disposed within at least a portion of the first passageway 28. The second passageway 30 can be comprised of multiple passageways for diverting fluid away from the operational flow path 14.

The sleeve 34 includes a passageway 36 disposed therein in fluid communication with the inlet 20 and the operational flow path 14 of the vibratory tool 12. The sleeve 34 has a first position (FIGS. 1A-1D) and a second position (FIGS. 2A-2D) in the body 26. The sleeve 34 can be held in the first position with shear pins 37. In the first position, the passageway 36 of the sleeve 34 permits fluid to flow into the operational flow path 14 of the vibratory tool 12. To move the sleeve 34 into the second position, a fluid blocking member 38, such as a ball, is pumped down through the inlet 20 of the bypass tool 10 and contacts a seat 40 which prevents fluid from flowing through the passageway 36 of the sleeve 34, through the first passageway 28 of the body 26, and the operational flow path 14 of the vibratory tool 12. Once the fluid blocking member 38 contacts the seat 40 and prevents fluid from passing through the sleeve 34, the sleeve 34 is forced down the first passageway 28 in the body 26. When the sleeve 34 is moved a specific distance in the first passageway 28, at least one throughway 42 is exposed, which is in fluid communication with the inlet 20 and the second passageway 30. The at least one throughway 42 allows fluid to flow from inlet 20 into the second passageway 30. The first passageway 28 can include a shoulder 44 to prevent the sleeve 34 from passing all the way through the first passageway 28 and out of the body 26.

Fluid flowing from the inlet 20, through the at least one throughway 42 and into the second passageway 30 is directed into an annulus 46 disposed between the vibratory tool 12 and the housing 19. From the annulus 46, the fluid flows out of the bypass tool 10 via the outlet 22 of the bypass tool 10.

Figure 3A:
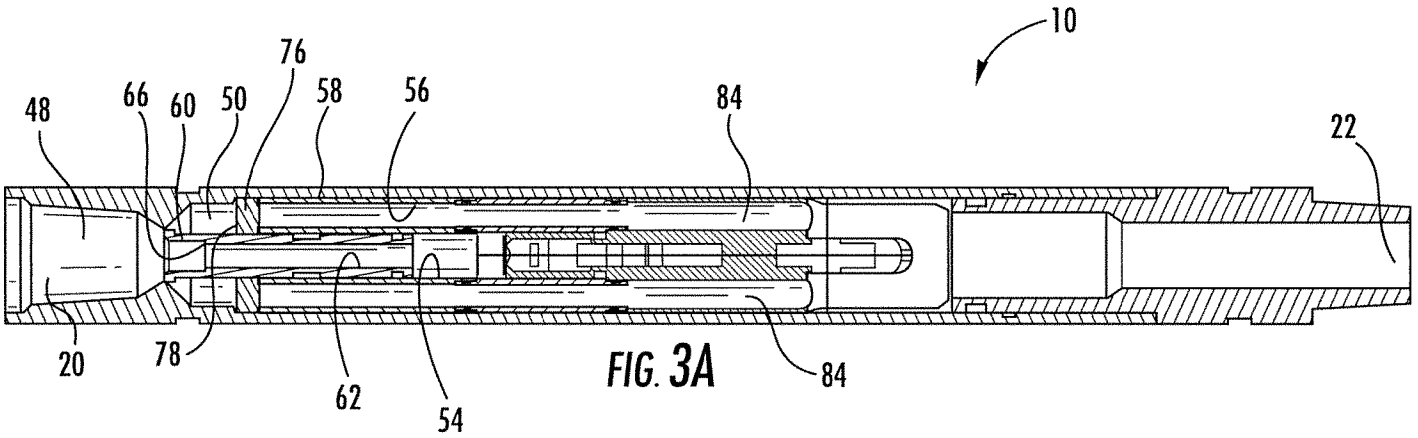
FIG. 3A is a cross-sectional view of another embodiment of the bypass tool constructed in accordance with the present disclosure.
Figure 3B:
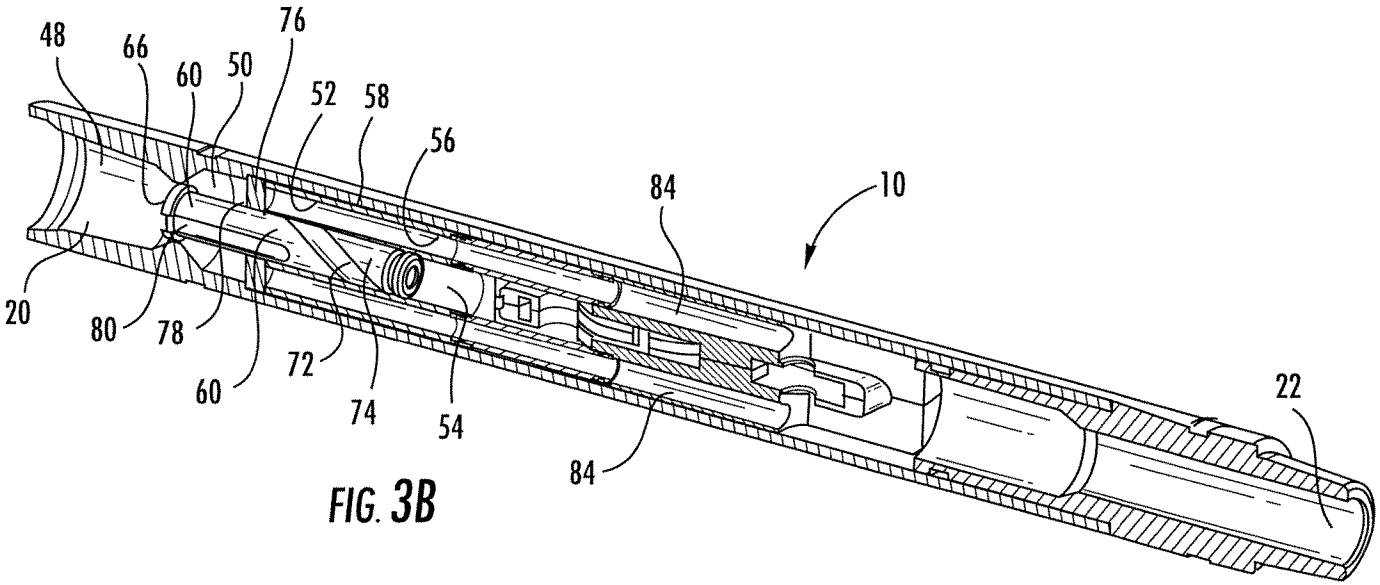
FIG. 3B is a perspective view of another embodiment of the bypass tool constructed in accordance with the present disclosure.
Figure 3C:
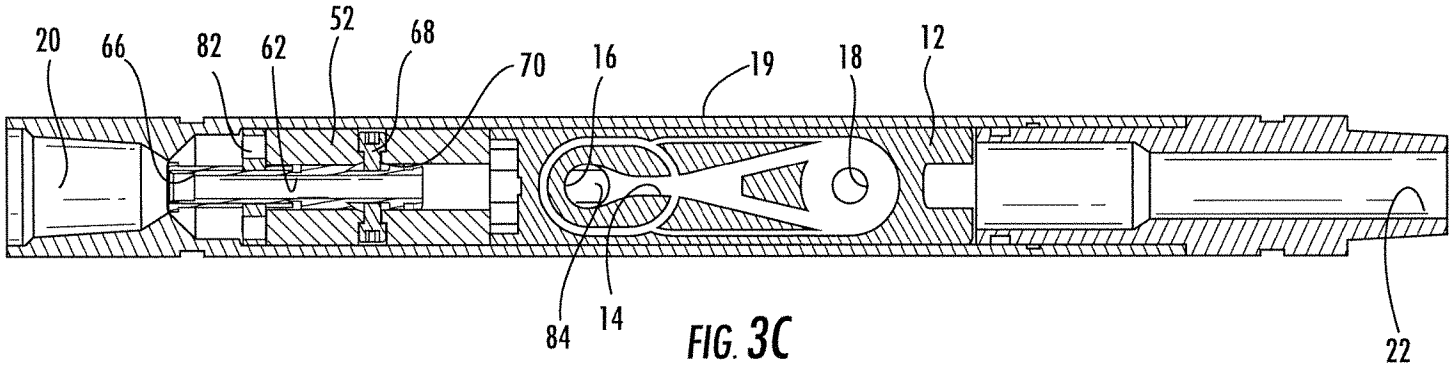
FIG. 3C is a cross-sectional view of the bypass tool shown in FIG. 3A rotated 90° constructed in accordance with the present disclosure.
Figure 3D:
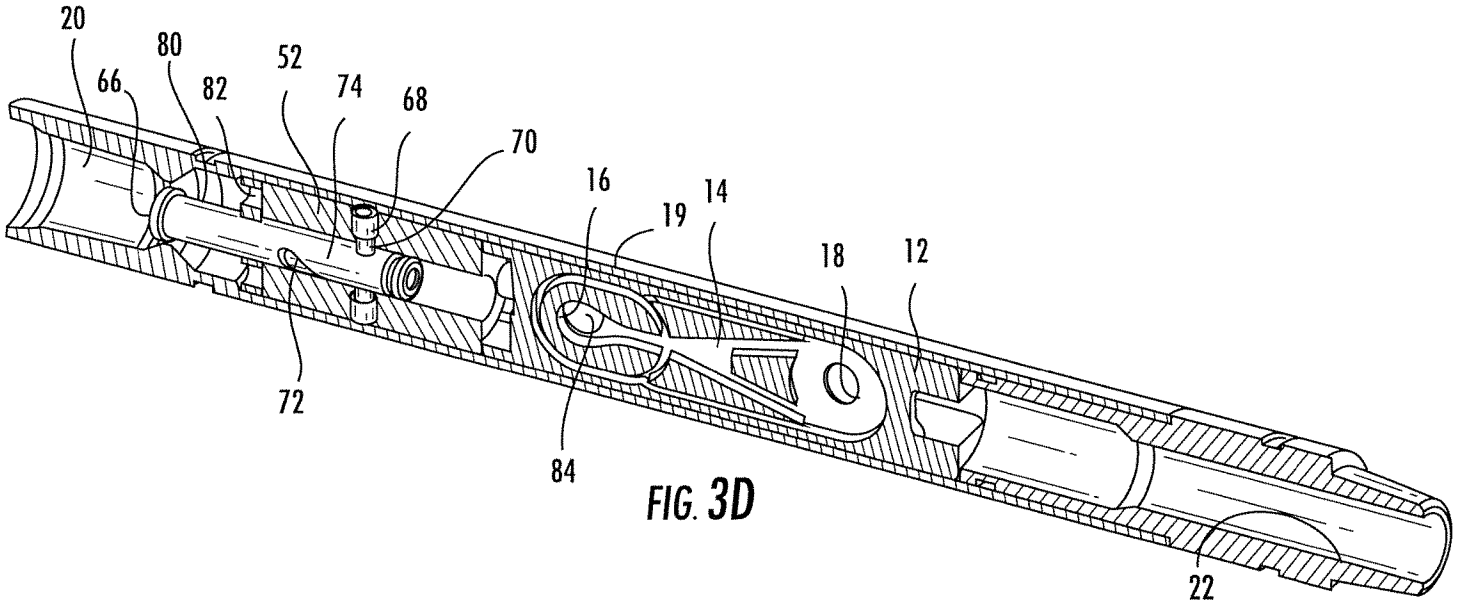
FIG. 3D is a perspective view of the the bypass tool shown in FIG. 3C rotated 90° constructed in accordance with the present disclosure.
Figure 4A:
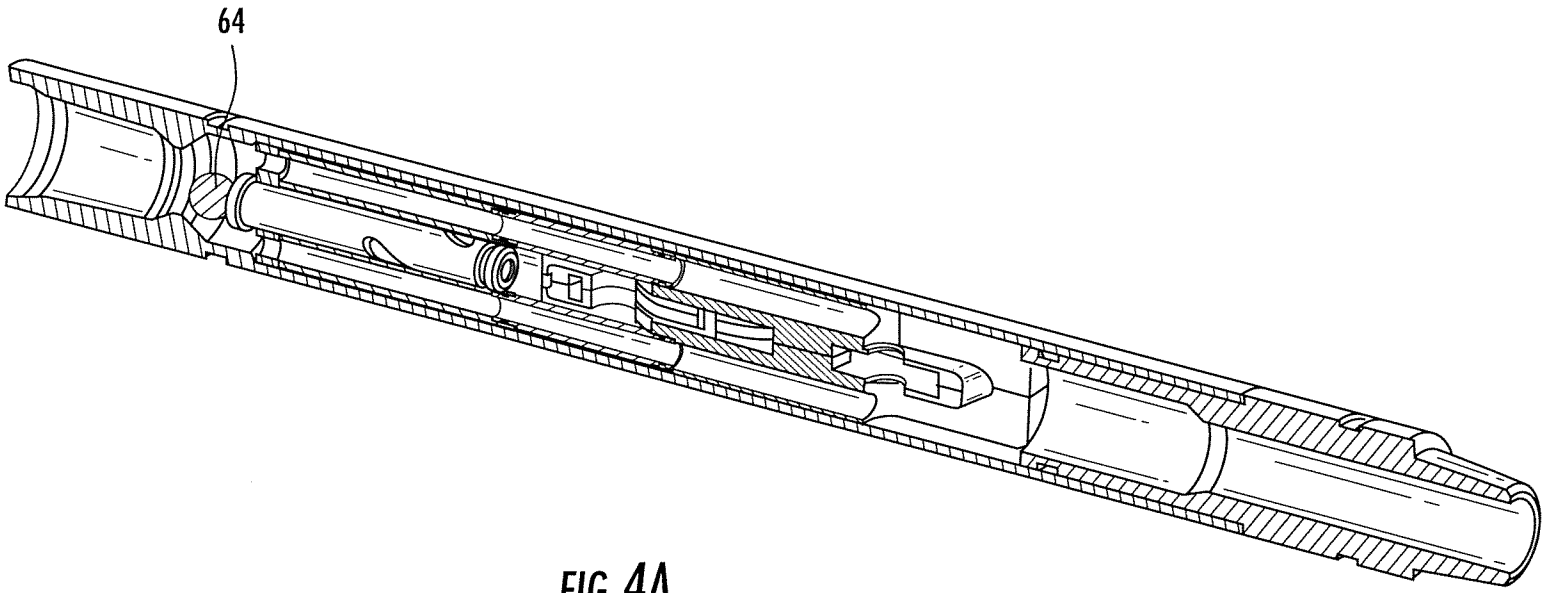
FIG. 4A is a perspective view of another embodiment of the bypass tool constructed in accordance with the present disclosure.
Figure 4B:
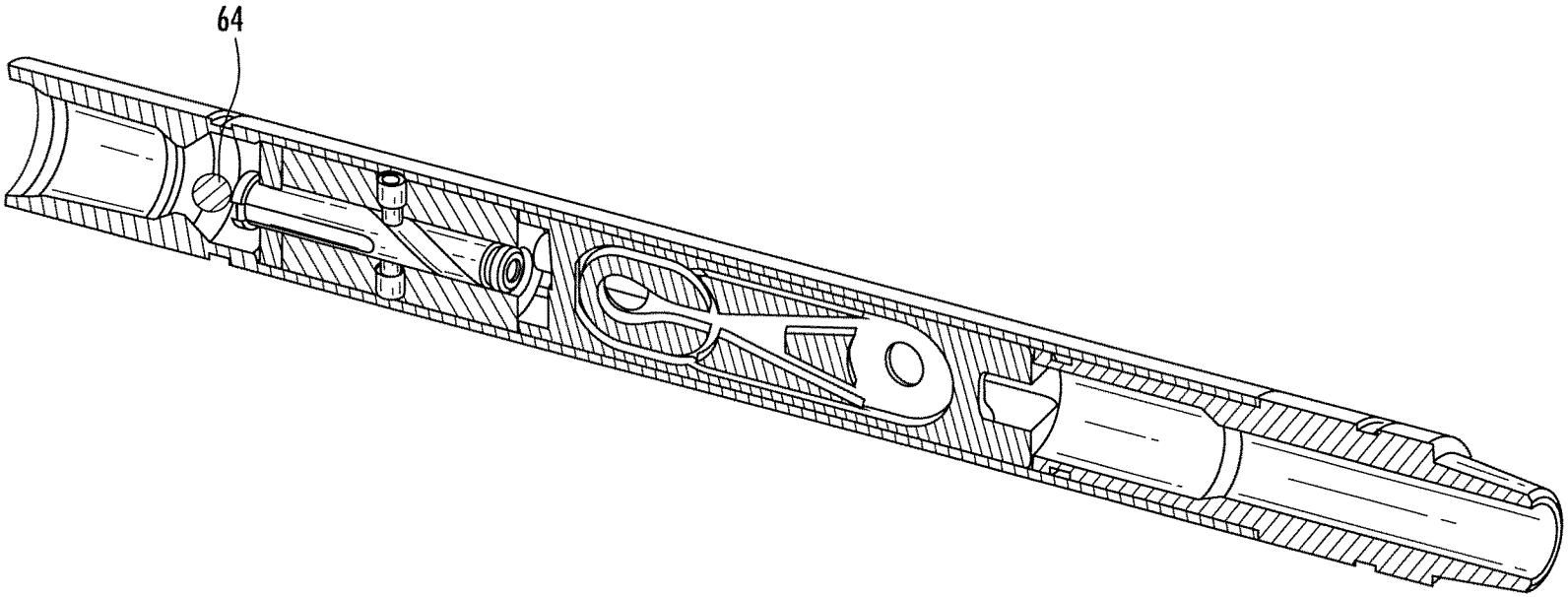
FIG. 4B is a cross-sectional view of the bypass tool shown in FIG. 4A rotated 90° constructed in accordance with the present disclosure.

In another embodiment of the bypass tool 10 shown in FIGS. 3A-4B, the inlet 20 can have a first chamber 48 and a second chamber 50. FIGS. 3A-4B depict another embodiment of the flow directing apparatus 24 as well. In this embodiment, the flow directing apparatus 24 includes a body 52 rotatably disposed within the bypass tool 10 and in fluid communication with the inlet 20 of the bypass tool 10. The flow directing apparatus 24 also includes a first passageway 54 disposed in the body 52 in fluid communication with the inlet 20 and the operational flow path 14 of the vibratory tool 12, a second passageway 56 disposed in an outer portion 58 of the body 52 or outside of the body 52 for diverting fluid away from the operational flow path 14 of the vibratory tool 12 and a sleeve 60 slidably and rotatably disposed within at least a portion of the first passageway 54. The second passageway 56 can be comprised of multiple passageways for diverting fluid away from the operational flow path 14.

The sleeve 60 includes a passageway 62 disposed therein in fluid communication with the first chamber 48 of the inlet 20 and the operational flow path 14 of the vibratory tool 12. The sleeve 60 has a first position (FIGS. 3A-3D) and a second position (FIGS. 4A-4B) in the body 52. In the first position, the passageway 62 of the sleeve 60 permits fluid to flow into the operational flow path 14 of the vibratory tool 12 and at least partially prevents fluid from moving from the first chamber 48 into the second chamber 50 of the inlet 20.

In one embodiment, the flow directing apparatus 24 includes a first guiding element 68 securely disposed within the body 52 that includes at least one guiding pin 70 extending inwardly therefrom to engage a first depression area 72 disposed in an outside portion 74 of the sleeve 60. The first depression area 72 can be shaped such that as the first depression area 72 extends longitudinally (uphole and downhole direction), the first depression area 72 extends around a portion of the sleeve 60. In a further embodiment, the flow directing apparatus 24 includes a second guiding element 76 securely disposed in the bypass tool 10 and adjacent to the body 52. The second guiding element 76 includes at least one guiding pin 78 extending inwardly therefrom to engage a second depression area 80 disposed in the outside portion 74 of the sleeve 60 and at least one port 82 in fluid communication with the second chamber 50 of the inlet 20. The at least one port 82 is also in fluid communication with the second passageway 56 of the body 52 when the sleeve 60 is in the second position.

To move the sleeve 60 into the second position, a fluid blocking member 64, such as a ball, is pumped down through the inlet 20 of the bypass tool 10 and contacts a seat 66 which prevents fluid from flowing through the passageway 62 of the sleeve 60, through the first passageway 54 of the body 52, and/or the operational flow path 14 of the vibratory tool 12. Once the fluid blocking member 64 contacts the seat 66 and prevents fluid from passing through the sleeve 60, the sleeve 60 is forced downward. This forces the at least one guiding pin 70 of the first guiding element 68 to slide or move in the first depression area 72, which causes the body 52 to rotate as the sleeve 60 moves downward. After the body 52 rotates a specific amount the at least one port 82 will be generally aligned with the second passageway 56 in the body 52. It should be under stood that the first depression area 72 is designed such that its longitudinal length and the amount it is disposed around the sleeve 60 permits the at least one port 82 to be generally aligned with the second passageway 56. This permits fluid flowing into the inlet 20 of the bypass tool 10 to flow through the at least one port 82, into the second passageway 56 and into at least one throughway 84 disposed in a portion of the vibratory tool 12. The fluid can then flow from the at least one throughway 84 and out the outlet 22 of the bypass tool 10. In another embodiment, the fluid can flow from the second passageway 56 into an annulus area (not shown in FIGS. 3A-4B) outside of the vibratory tool 12 and then out of the outlet 22 of the bypass tool 10, which is similar to what is shown and described in FIGS. 1A-2D.

In a further embodiment of the present disclosure, various parts of the bypass tool 10 shown in FIGS. 3A-4B operate differently. In this embodiment, the body 52 of the flow directing apparatus 24 is securely disposed in the bypass tool 10 and the second guiding element 72 is rotatably disposed within the bypass tool 10. To align the at least one port 82 with the second passageway 56 in the body 52, the sleeve 60 has to be moved into the second position.

To move the sleeve 60 into the second position in this embodiment, the fluid blocking member 64 is pumped down through the inlet 20 of the bypass tool 10 and contacts the seat 66 which prevents fluid from flowing through the passageway 62 of the sleeve 60, through the first passageway 54 of the body 52, and/or the operational flow path 14 of the vibratory tool 12. Once the fluid blocking member 64 contacts the seat 66 and prevents fluid from passing through the sleeve 60, the sleeve 60 is forced downward. This forces the sleeve 60 to rotate as the sleeve 60 is moved downward due to the engagement of the first depression area 72 of the sleeve 60 with the at least one guiding pin 70 of the first guiding element 68. As the sleeve 60 rotates as it is moved downward, the engagement of the second depression area 80 disposed on the sleeve 60 with the guiding pin 78 of the second guiding element 76 causes the second guiding element 76 to rotate in the bypass tool 10. After the second guiding element 76 rotates a specific amount the at least one port 82 will be generally aligned with the second passageway 56 in the body 52. It should be under stood that the first depression area 72 is designed such that its longitudinal length and the amount it is disposed around the sleeve 60 permits the at least one port 82 to be generally aligned with the second passageway 56. This permits fluid flowing into the inlet 20 of the bypass tool 10 to flow through the at least one port 82, into the second passageway 56 and into at least one throughway 84 disposed in a portion of the vibratory tool 12. The fluid can then flow from the at least one throughway 84 and out the outlet 22 of the bypass tool 10.

Figure 5A:
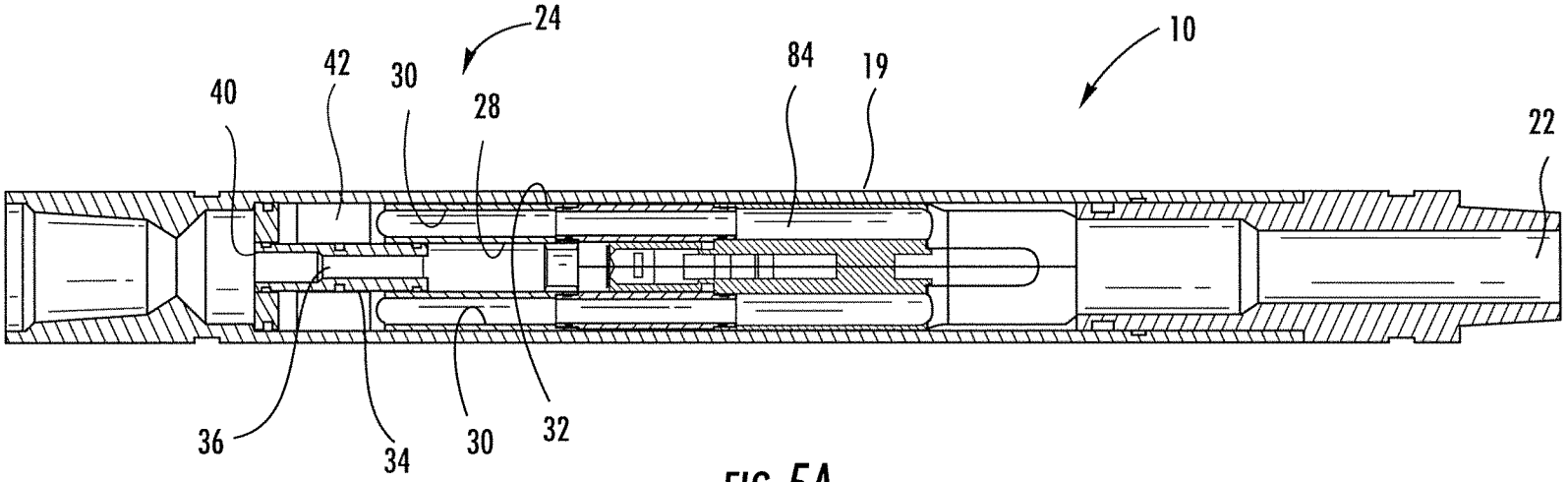
FIG. 5A is a cross-sectional view of another embodiment of the bypass tool constructed in accordance with the present disclosure.
Figure 5B:
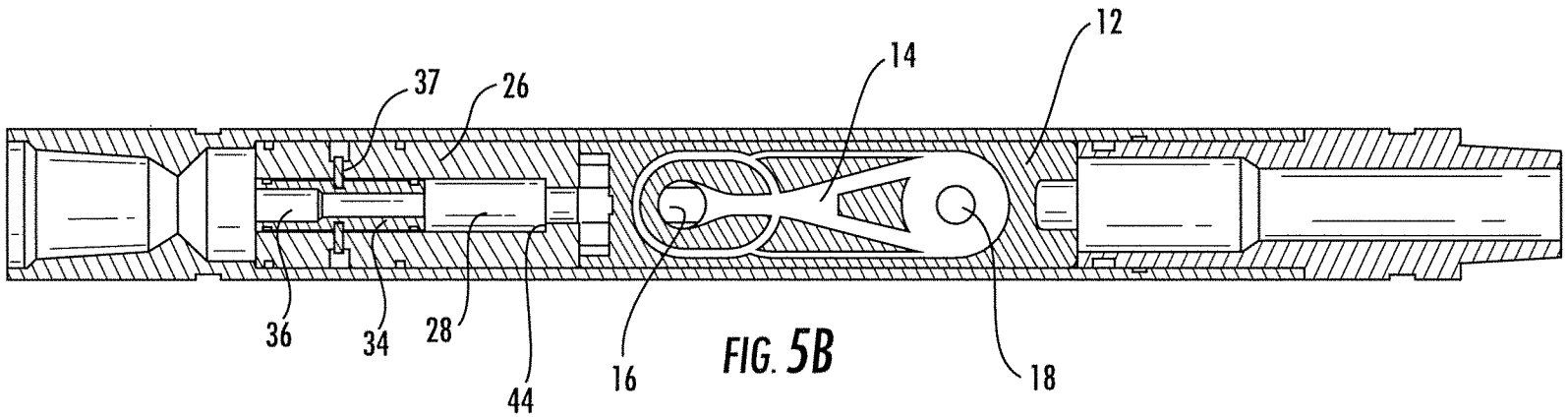
FIG. 5B is a cross-sectional view of the bypass tool shown in FIG. 5A rotated 90° constructed in accordance with the present disclosure.
Figure 5C:
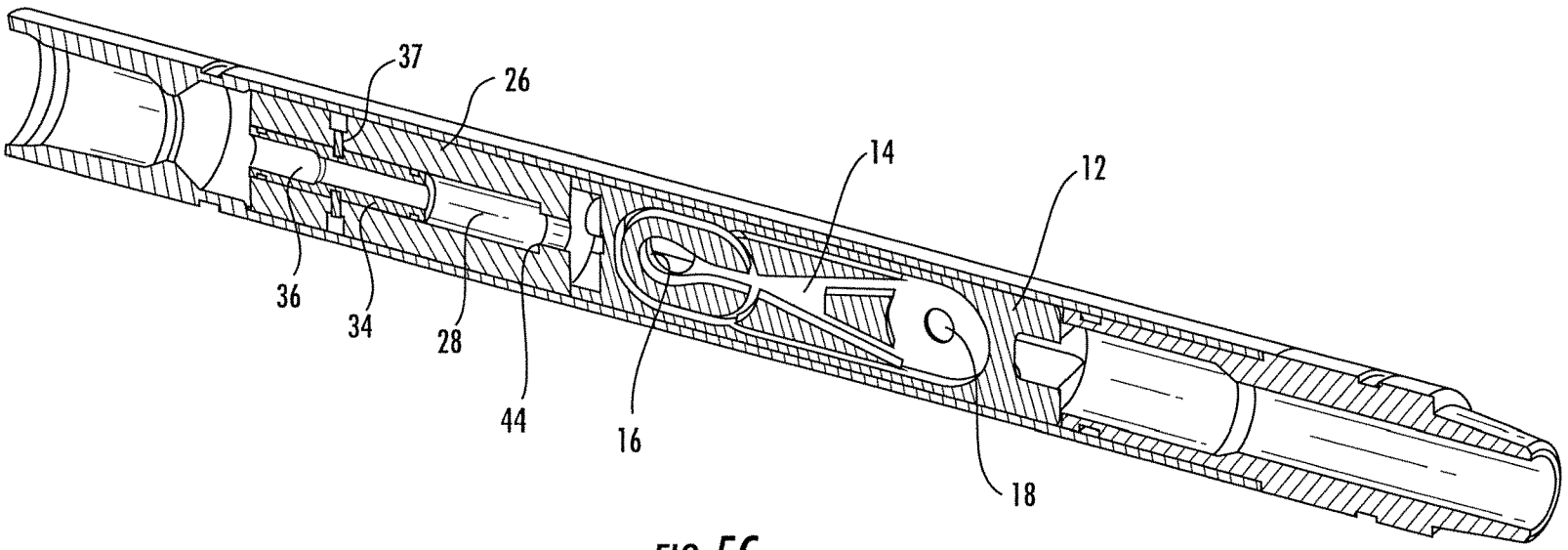
FIG. 5C is a perspective view of the bypass tool shown in FIG. 5B constructed in accordance with the present disclosure.
Figure 6A:
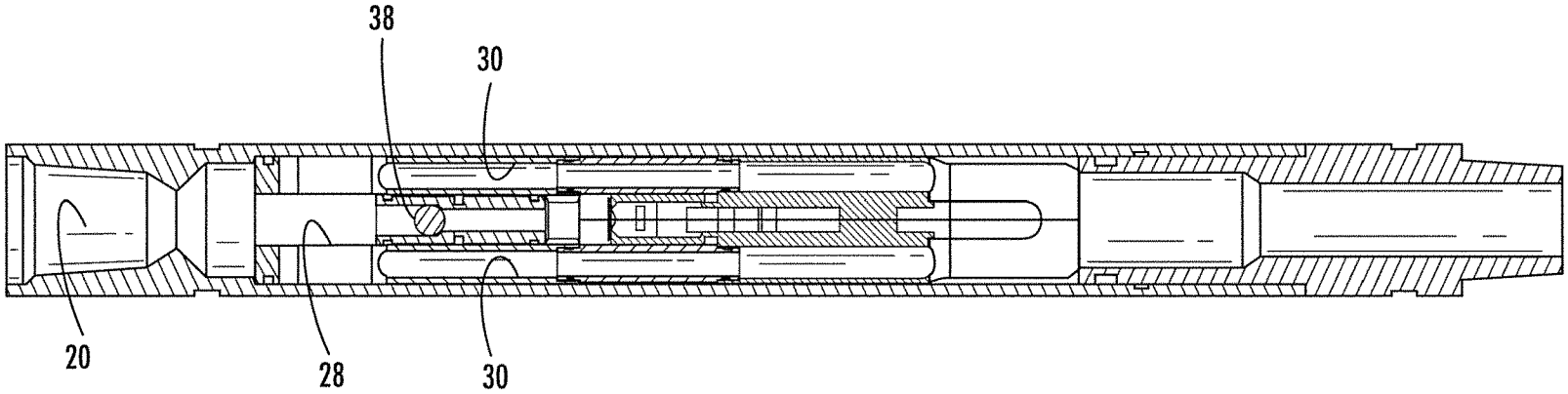
FIG. 6A is a cross-sectional view of another embodiment of the bypass tool constructed in accordance with the present disclosure.
Figure 6B:
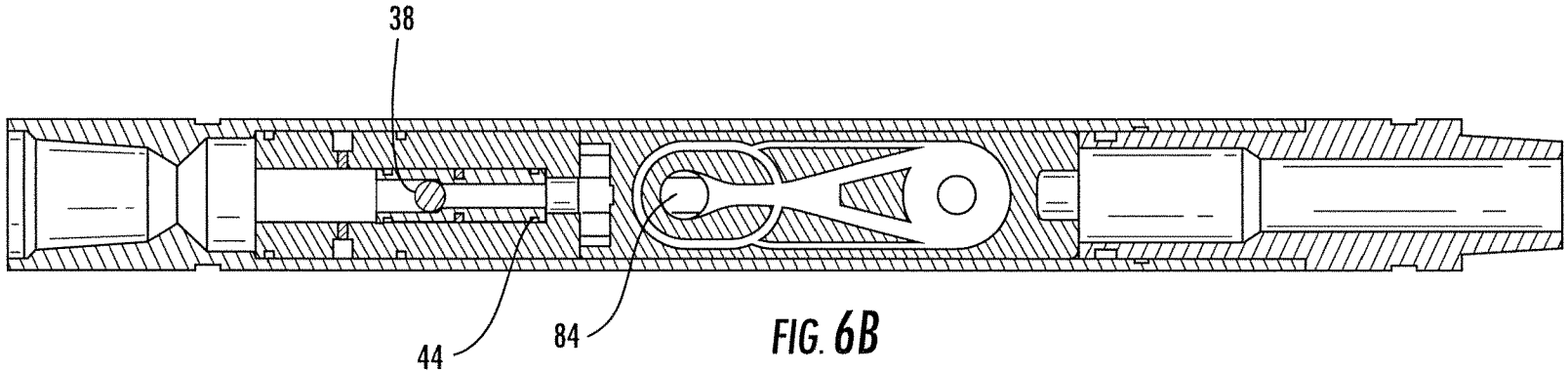
FIG. 6B is a cross-sectional view of the bypass tool shown in FIG. 6A rotated 90° constructed in accordance with the present disclosure.
Figure 6C:
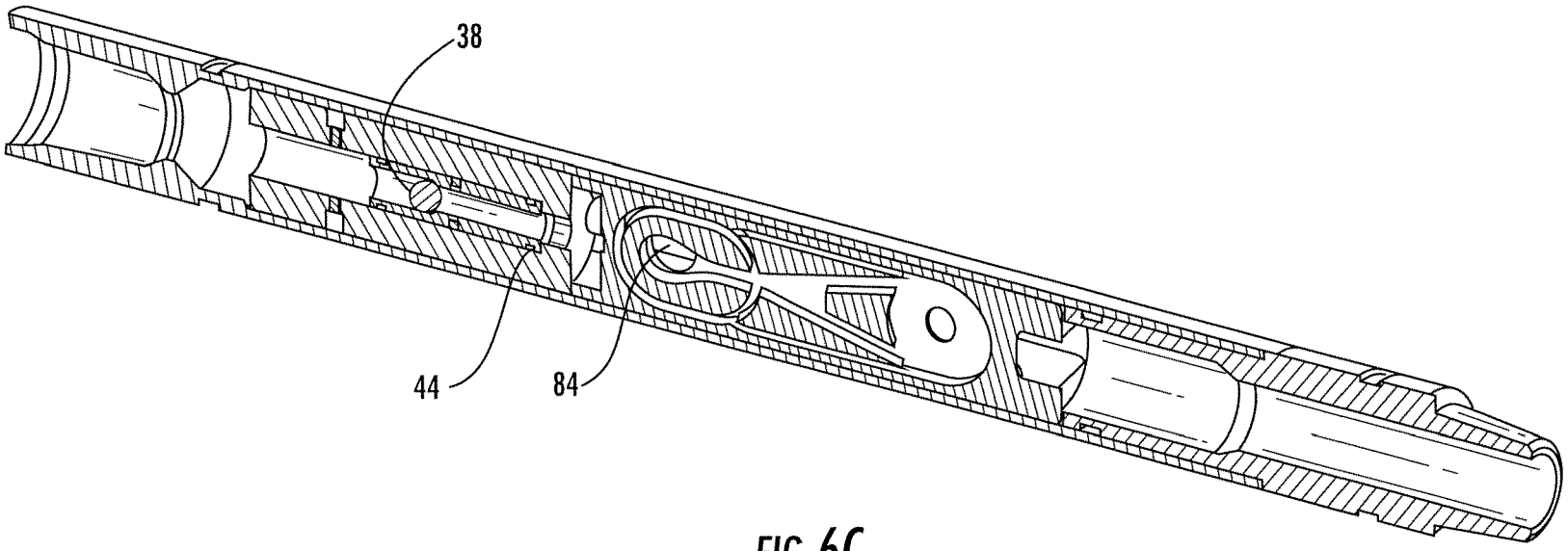
FIG. 6C is a perspective view of the bypass tool shown in FIG. 6B constructed in accordance with the present disclosure.

In yet another embodiment of the present disclosure shown in FIGS. 5A-6C, the flow directing apparatus 24 is designed similar to that shown and described in FIGS. 1A-2D. In this embodiment of the bypass tool 10, the second passageway 30 is in fluid communication with the at least one throughway 84 (as shown and described in FIGS. 3A-4B) disposed in a portion of the vibratory tool 12. The fluid can then flow from the second passageway 30, through the at least one throughway 84 and out the outlet 22 of the bypass tool 10.

The present disclosure is also directed toward a method of using the bypass tool. The method includes the step of providing the BHA into a well. The BHA can include the vibratory tool 12, the bypass tool 10 and and a perforator (not shown). The BHA can also include a packer (not shown) as well as any other downhole tool known in the art. In one embodiment, the BHA can be run down into a well with a perforator disposed uphole of the vibratory tool 12. Operating fluid can then be pumped through the perforator to the vibratory tool 12 to operate the vibratory tool 12. Operating fluid can then be prevented from flowing through the perforator (fluid could still be pumped into the perforator) to the vibratory tool 12, which would prevent the operation of the vibratory tool 12. An abrasive fluid can then be pumped out of nozzles in the perforator to create perforations in the well. The flow of abrasive fluid and/or operating fluid can then be prevented from flowing out of the nozzles and the flow of operating fluid can be pumped back through the perforator to the vibratory tool 12 to again operate the vibratory tool 12.

In another embodiment, the vibratory tool 12 is positioned above (or uphole) the perforator in the BHA. Operating fluid is pumped to the operational flow path 14 of the vibratory tool 12 to operate the vibratory tool 12 and to the perforator and any other tools in the BHA. The operational flow path 14 of the vibratory tool 12 can then be bypassed and abrasive fluid can be pumped to the perforator to create perforations in the well via nozzles disposed in the perforator. In another embodiment, the abrasive fluid can be pumped through the operational flow path 14 of the vibratory tool 12 to the perforator and through nozzles in the perforator to create the perforations in the well. In this embodiment, the vibratory tool 12 is allowed to be worn by the abrasive fluid flowing therethrough.

From the above description, it is clear that the present disclosure is well adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A method, the method comprising:

running a bottom hole assembly (BHA) into a well, the bottom hole assembly including a vibratory tool disposed above a perforator in the BHA and a bypass tool disposed above the vibratory tool wherein the fluid pumped to the operational flow path of the vibratory tool to operate the vibratory tool flows through the bypass tool;

an inlet for receiving fluid into a housing of the downhole tool; and a flow directing apparatus disposed in the housing, the flow directing apparatus having a first position and a second position, the flow directing apparatus in the first position directs fluid to flow into an operational flow path of a vibratory tool at least partially disposed within the housing of the downhole tool to operate the vibratory tool and the flow directing apparatus in the second position causes the fluid to bypass the operational flow path of the vibratory tool; the flow directing apparatus comprises:

a body securely disposed within the downhole tool, the downhole tool having a first passageway in fluid communication with the inlet and the operational flow path of the vibratory tool and a second passageway that diverts fluid away from the operational flow path of the vibratory tool; and a sleeve slidably and rotatably disposed in the first passageway of the body, the sleeve has a first position where fluid is permitted to pass through the passageway in the sleeve to pass to the operational flow path of the vibratory tool and a second position where fluid is blocked from the passing through the passageway and the fluid is diverted to the second passageway of the body;

pumping fluid to an operational flow path of the vibratory tool to operate the vibratory tool; and pumping abrasive fluid through the operational flow path of the vibratory tool to the perforator to create perforations in the well.

2. The method of claim 1 wherein the flow directing apparatus further comprises;

a first and second depression area disposed on an outside portion of the sleeve, the first depression area extends a predetermined length of the sleeve and extends around the outside portion of the sleeve, the second depression area extending substantially longitudinal on the sleeve;

a first guiding element securely disposed within the body for engaging the first depression area of the sleeve and forcing the rotation of the body as the sleeve is forced downward in the body;

a second guiding element rotatably disposed in the housing for engaging the second depression area of the sleeve to allow for rotation of the second guiding element as the sleeve is rotated as it is forced downward toward the second position, the second guiding element having at least one port that prevents fluid from flowing into the second passageway in the body when the sleeve is in the first position and in alignment with the second passageway of the body when the sleeve is in the second position.

3. The method of claim 1 wherein the sleeve further includes a seat for receiving a fluid blocking member to prevent fluid from flowing through the passageway of the sleeve and forces the sleeve from the first position to the second position.

4. The method of claim 1 wherein the second passageway is in fluid communication with the inlet of the downhole tool and with an annulus area between the vibratory tool and the housing of the downhole tool.

5. The method of claim 1 wherein the second passageway is in fluid communication with the inlet of the downhole tool and with a throughway disposed in a portion of the vibratory tool.

6. The method of claim 1 wherein the second passageway is comprised of multiple passageways.

7. The method of claim 1 wherein the throughway in the body is comprised of multiple throughways.

* * * * *